US007467632B2

(12) United States Patent
Lee et al.

(10) Patent No.: US 7,467,632 B2
(45) Date of Patent: Dec. 23, 2008

(54) METHOD FOR FORMING A PHOTORESIST PATTERN

(75) Inventors: Geun Su Lee, Yongin-si (KR); Cheol Kyu Bok, Seoul (KR)

(73) Assignee: Hynix Semiconductor Inc., Icheon-si (KR)

( * ) Notice: Subject to any disclaimer, the term of this patent is extended or adjusted under 35 U.S.C. 154(b) by 230 days.

(21) Appl. No.: 11/650,141

(22) Filed: Jan. 4, 2007

(65) Prior Publication Data

US 2007/0163625 A1 Jul. 19, 2007

Related U.S. Application Data

(62) Division of application No. 10/999,248, filed on Nov. 30, 2004, now abandoned.

(30) Foreign Application Priority Data

Jan. 5, 2004 (KR) ..... 10-2004-0000289

(51) Int. Cl.
*B08B 3/04* (2006.01)
*C11D 3/28* (2006.01)
*C11D 1/00* (2006.01)

(52) U.S. Cl. ..... 134/1.3; 510/176; 510/500

(58) Field of Classification Search ..... None
See application file for complete search history.

(56) References Cited

U.S. PATENT DOCUMENTS 5,534,396 A 7/1996 McGuckin et al. ..... 430/463
6,537,957 B1 3/2003 Cardola et al. ..... 510/238

FOREIGN PATENT DOCUMENTS

WO WO 00/12661 3/2000

*Primary Examiner*—Gregory R Del Cotto
(74) *Attorney, Agent, or Firm*—Marshall, Gerstein & Borun LLP

(57) ABSTRACT

A photoresist cleaning solution and method for forming photoresist patterns using the same. More specifically, disclosed are a photoresist cleaning solution comprising $H_2O$ and an ionic surfactant represented by Formula 1, and a method for forming a photoresist pattern using the same. By spraying the cleaning solution of the present invention over photoresist film before and/or after exposing step, pattern formation in an undesired region caused by ghost images can be removed.

Formula 1

4 Claims, 3 Drawing Sheets

METHOD FOR FORMING A PHOTORESIST PATTERN

CROSS-REFERENCE TO RELATED APPLICATION

This is a divisional of currently assigned application Ser. No. 10/999,248 filed Nov. 30, 2004, now abandoned the disclosure of which is incorporated herein by reference

BACKGROUND

1. Technical Field

Photoresist cleaning solutions are disclosed that prevent undesired ghost pattern formation when cleaning solution is sprayed over photoresist film before or after the pattern is exposed. Methods for pattern formation using the disclosed cleaning solutions are also disclosed.

2. Description of the Related Art

According to current methods for forming photoresist patterns on semiconductor substrates, the underlying layer is formed first on the substrate, and photoresist film is formed over the underlying layer. Then, the photoresist film is exposed to light and developed to obtain photoresist pattern, thereby exposing a part of the underlying layer. When a positive photoresist film is used, the photoresist film of the exposed region is removed using a developing solution.

However, in such a process, there is a problem of undesired pattern formation, i.e. side lobe, by the acid generated at the photosensitizer coating film of an unexposed region due to a ghost image at the undesired region during the exposing procedure. The acid detaches the protecting group of the photosensitizer during baking step and the detached protecting group is removed by the developing solution.

SUMMARY OF THE DISCLOSURE

Accordingly, disclosed herein are photoresist cleaning solutions for preventing undesired photoresist pattern formation caused by ghost images.

Also, disclosed herein are methods for photoresist pattern formation using the disclosed cleaning solution and semiconductor devices produced by the disclosed method.

DETAILED DESCRIPTION OF THE PRESENTLY PREFERRED EMBODIMENTS

Figure 1:
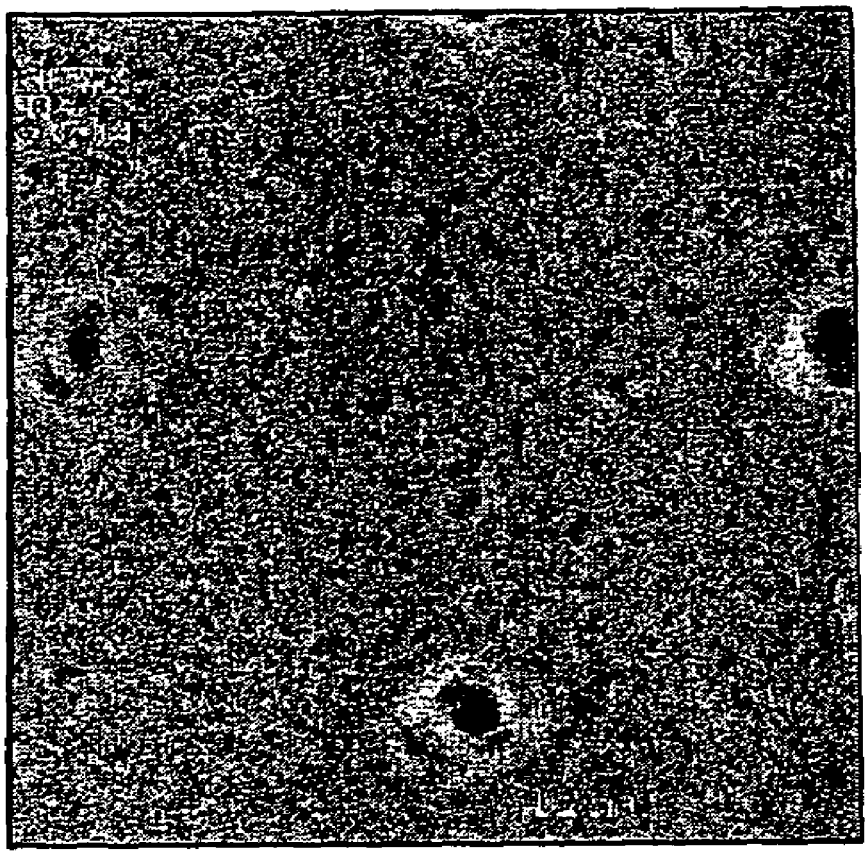
FIG. 1 is a photograph showing a photoresist pattern formed by conventional method of pattern formation.

Photoresist cleaning solutions are disclosed that are useful for removing ghost images created during pattern formation.

Also, a method for forming a photoresist pattern is disclosed that uses the disclosed cleaning solutions and semiconductor devices fabricated by the above described method are disclosed.

The disclosed photoresist cleaning solution also comprises $H_2O$ and an ionic surfactant of Formula 1:

Formula 1

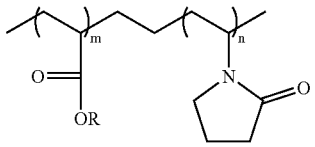

wherein R is selected from the group consisting of H, $C_1$-$C_{20}$ alkyl or alkylaryl and $C_3$-$C_{10}$ aromatic ring. Herein, R is preferably selected from the group consisting of H, methyl, ethyl, propyl, butyl, octyl, octylphenyl, nonyl, nonylphenyl, decyl, decylphenyl, undecyl, undecylphenyl, dodecyl and dodecylphenyl. Also, m is an integer ranging from 0 to 100, and n is an integer ranging from 10 to 300.

The water contained in the cleaning solution of the present invention is preferably distilled water and may further comprise alcohol. The alcohol can preferably be $C_1$-$C_{10}$ alkylalcohol or alkoxyalcohol. More preferably, said alkylalcohol is selected from the group consisting of methanol, ethanol, propanol, iso-propanol, n-butanol, sec-butanol, tert-butanol, 1-pentanol, 2-pentanol, 3-pentanol, 2,2-dimethyl-1-propanol and mixtures thereof, and alkoxyalcohol is selected from the group consisting of 2-methoxyethanol, 2-(2-methoxyethoxy) ethanol, 1-methoxy-2-propanol and 3-methoxy-1,2-propandiol, and mixtures thereof.

In the disclosed cleaning solution, a ratio of the compound represented by Formula 1:alcohol:$H_2O$ is preferably 0.001~5 wt %:0~10 wt %:85~99.999 wt %.

A disclosed cleaning solution can preferably be used after filtering a mixture of the distilled water, the compound of Formula 1 and the alcohol compound with a 0.2 μm filter. The disclosed solutions are useful for a process using a developing solution, that is, for a photoresist pattern formation process with a wet-developing process.

Since the amount of acid generated by ghost images is less than that of the acid generated in a properly exposed region, the acid is generated in small amounts in an undesired region of the photoresist film and the acid can be neutralized or removed by washing the photoresist film with the cleaning solution after exposing step. The above-described process can also be performed before the exposing step. When the photosensitive film is treated with the cleaning solution before the exposing step, the acid generated after the exposing step is slowly diffused due to a thin water film layer formed on the photosensitive surface. Moreover, some of photoacid generator (abbreviated as "PAG") which is a part of the photoresist layer is washed out so that the amount of acid generated is reduced during the exposing process. The acid generated in the undesired region by ghost images can be removed by the above-described method, thereby obtaining desired photoresist pattern only.

In addition, a method for forming a photoresist pattern by using the above cleaning solution is disclosed. The method is characterized by spraying the disclosed cleaning solution over the photoresist film before or after a conventional exposing step. The method comprises:

(1) coating a photoresist composition on top of an underlying layer formed on a semiconductor substrate to form a photoresist film;

(2) exposing the photoresist film with an exposure light; and (3) developing the exposed photoresist film with a developing solution. The disclosed cleaning solution may be sprayed twice before and after the exposure step (2).

The method may further comprise a soft-baking step and/or a post-baking step before and after the exposing step, respectively. The baking process is preferably performed at a temperature ranging from 70 to 200° C.

Preferably, the exposure light is selected from the group consisting of VUV (157 nm), ArF (193 nm), KrF (248 nm), EUV (13 nm), E-beam, X-ray and ion beam, and the exposing step (2) is performed with an exposure energy ranging from 0.1 to 50 mJ/cm$^2$.

The developing step (3) can be performed with an alkaline developing solution, preferably TMAH aqueous solution ranging from 0.01 to 5 wt %.

In addition, there is provided a semiconductor device fabricated using the disclosed method.

The disclosed cleaning solution will be described in more detail referring to examples below, which are not intended to limit the scope of this disclosure.

EXAMPLE 1

Preparation of Disclosed Cleaning Solution (1)

0.1 g of poly(vinylpyrrolidone) having average molecular weight of 10,000, and 1,000 g of $H_2O$ were mixed and stirred for 1 minute. The resulting mixture was filtered through a 0.2 μm filter to obtain a cleaning solution (1).

EXAMPLE 2

Preparation of Disclosed Cleaning Solution (2)

0.1 g of poly(vinylpyrrolidone-vinyl acrylic acid) copolymer (3:7) having average molecular weight of 10,000, 30 g of ethanol and 970 g of $H_2O$ were mixed and stirred. The resulting mixture was filtered through a 0.2 μm filter to obtain a cleaning solution (2).

COMPARATIVE EXAMPLE 1

Typical Patterning Process

Hexamethyldisilazane (HMDS)-treated underlying layer was formed on a silicon wafer, and TarF-7a-39 (available from TOK Co., Ltd.) as a methacrylate type photosensitizer was spin-coated to prepare a photoresist thin film at 3,500 Å thickness over the underlying layer. Then, the photoresist film was soft-baked at 130° C. for 90 seconds. After completion of the soft-baking, the photoresist film was exposed to light using an ArF laser exposure apparatus, then was post-baked at 130° C. for 90 seconds. When the baking was completed, the silicon wafer was developed in a 2.38 wt % aqueous TMAH solution for 30 seconds to obtain a 150 nm contact hole pattern (see FIG. 1).

EXAMPLE 3

Pattern Formation Using Cleaning Solution (1)

Figure 2:
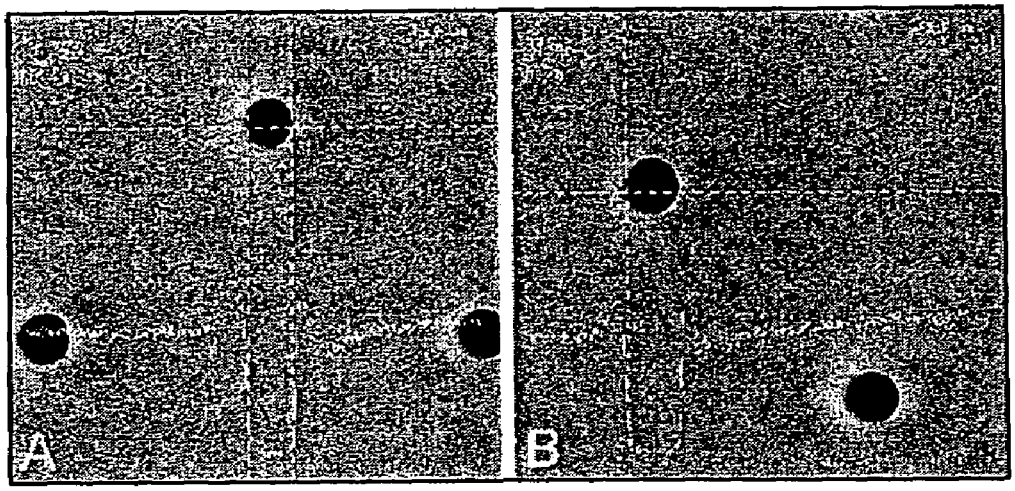
FIG. 2 is a photograph showing a photoresist pattern obtained by treating a photoresist film with a disclosed photoresist cleaning solution after the exposing process.

The same process of Comparative Example 1 was performed except further spraying 100 ml of the cleaning solution (1) prepared in Example 1 over the photoresist film 1 after the exposing step to obtain 150 nm contact hole pattern (see part A of FIG. 2).

EXAMPLE 4

Pattern Formation Using Cleaning Solution (2)

The same process of Comparative Example 1 was performed except further spraying 100 ml of the cleaning solution (2) prepared in Example 2 over the photoresist film after the exposing step to obtain 150 nm contact hole pattern (see part B of FIG. 2).

EXAMPLE 5

Pattern Formation Using Cleaning Solution (1)

Figure 3:
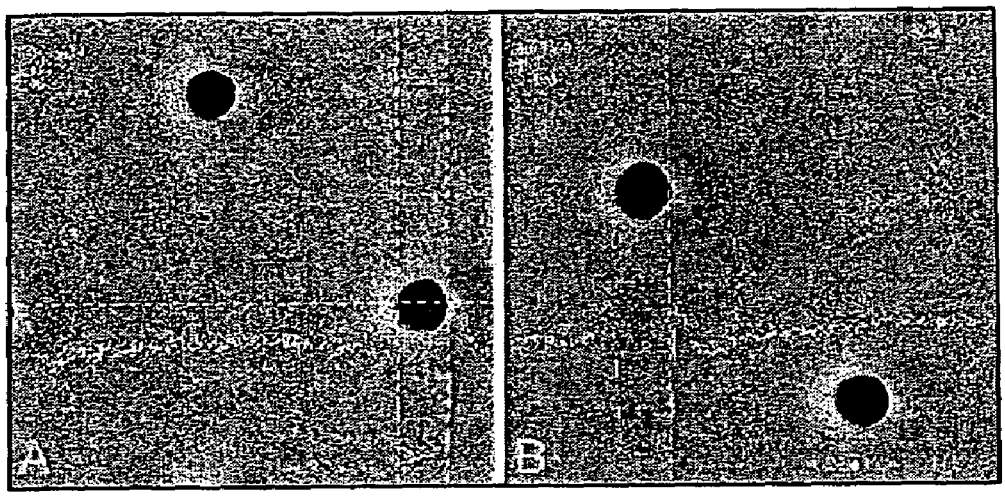
FIG. 3 is a photograph showing a photoresist pattern obtained by treating a photoresist film with a disclosed photoresist cleaning solution before the exposing process.

The same process of Comparative Example 1 was performed except further spraying 100 ml of the cleaning solution (1) prepared in Example 1 over the photoresist film before the exposing step to obtain 150 nm contact hole pattern (see part A of FIG. 3).

EXAMPLE 6

Pattern Formation Using Cleaning Solution (2)

The same process of Comparative Example 1 was performed except further spraying 100 ml of the cleaning solution (2) prepared in Example 2 over the photoresist film before the exposing step to obtain 150 nm contact hole pattern (see B of FIG. 3).

As described above, pattern formation in an undesired region caused by ghost images can be removed by spraying the disclosed cleaning solution over photoresist film before and/or after the exposing step.

What is claimed is:

1. A method for forming a photoresist pattern comprising:

(a) coating a photoresist composition on top of an underlying layer formed on a semiconductor substrate to form a photoresist film;

(b) exposing the photoresist film with an exposure light;

(c) developing the exposed photoresist film with a developing solution, and, (d) spraying a cleaning solution over the photoresist film before or after the exposing step (b), said cleaning solution comprising $H_2O$ and an ionic surfactant represented by Formula 1:

Formula 1

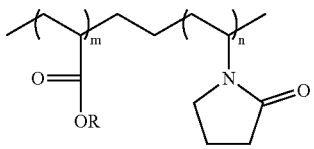

wherein R is selected from the group consisting of H, $C_1$-$C_{20}$ alkyl or alkylaryl, and $C_3$-$C_{10}$ aromatic rings; m is an integer ranging from 0 to 100; and n is an integer ranging from 10 to 300.

2. The method of claim 1, further comprising a soft-baking step and/or a post-baking step before and/or after the exposing step (b), respectively.

3. The method of claim 1, wherein the exposure light is selected from the group consisting of VUV (157 nm), ArF (193 nm), KrF (248 nm), EUV (13 nm), E-beam, X-ray and ion beam.

4. The method of claim 1, comprising performing the exposing step (b) with exposure energy ranging from 0.1 mJ/cm$^2$ to 50 mJ/cm$^2$.

* * * * *